US007230516B2

(12) United States Patent
Yu

(10) Patent No.: US 7,230,516 B2
(45) Date of Patent: Jun. 12, 2007

(54) CIRCUIT BREAKER

(76) Inventor: Tsung-Mou Yu, No. 4, Alley 2, Lane 23, Sec. 3, Pa Te Road, Panchiao City, Taipei Hsien (TW)

( * ) Notice: Subject to any disclaimer, the term of this patent is extended or adjusted under 35 U.S.C. 154(b) by 300 days.

(21) Appl. No.: 11/052,640

(22) Filed: Feb. 5, 2005

(65) Prior Publication Data

US 2006/0176141 A1 Aug. 10, 2006

(51) Int. Cl.
*H01H 73/30* (2006.01)
*H01H 73/22* (2006.01)

(52) U.S. Cl. ..... 337/66; 337/62

(58) Field of Classification Search ..... 361/62, 361/66

See application file for complete search history.

(56) References Cited

U.S. PATENT DOCUMENTS 3,361,882 A * 1/1968 Clarke ..... 337/74
3,564,174 A * 2/1971 Clarke ..... 337/52
3,629,762 A * 12/1971 Walling ..... 337/62
3,792,403 A * 2/1974 Bullock ..... 337/66
3,975,702 A * 8/1976 Carpenter ..... 337/62
3,990,028 A * 11/1976 Aust et al. ..... 337/46
4,024,487 A * 5/1977 Krasser et al. ..... 337/46
4,255,629 A * 3/1981 Bell ..... 200/61.45 R
4,342,979 A * 8/1982 Phillips ..... 337/41
4,400,677 A * 8/1983 Cobb et al. ..... 337/6
4,780,697 A * 10/1988 Cobb et al. ..... 337/70
4,812,799 A * 3/1989 Cobb et al. ..... 337/70
4,837,545 A * 6/1989 Cobb et al. ..... 337/66
4,939,495 A * 7/1990 Peterson et al. ..... 337/79
5,157,369 A * 10/1992 Yao ..... 337/68
5,459,446 A * 10/1995 Vidal et al. ..... 337/188
5,854,585 A * 12/1998 Kingma ..... 337/367
6,229,426 B1 * 5/2001 Lavado et al. ..... 337/57
6,353,526 B1 * 3/2002 Pellon ..... 361/115
6,448,880 B2 * 9/2002 Yu ..... 337/66
6,522,228 B2 * 2/2003 Wellner et al. ..... 335/18
6,642,832 B2 * 11/2003 Pellon et al. ..... 337/66
6,710,695 B1 * 3/2004 Pellon et al. ..... 337/66
6,900,405 B2 * 5/2005 Abraham et al. ..... 200/538
7,064,636 B1 * 6/2006 Walz et al. ..... 335/18
2002/0080003 A1 * 6/2002 Pellon et al. ..... 337/55
2002/0125981 A1 * 9/2002 Yu ..... 337/367
2002/0153990 A1 * 10/2002 Yu ..... 337/333
2003/0160679 A1 * 8/2003 Yu ..... 337/37

FOREIGN PATENT DOCUMENTS

DE 3313465 A * 10/1984
EP 285340 A2 * 10/1988

* cited by examiner

*Primary Examiner*—Anatoly Vortman

(57) ABSTRACT

A circuit breaker includes a body having a neck member integrally connected thereto. A flange extends from an inner periphery of the neck member and a recess is defined in an inner periphery of the flange. Two terminals are connected to the body and a bi-metallic plate has an end fixed to one of the terminals and there other end of the bi-metallic plate is a free end on which a contact point is connected so as to be in contact with another contact point on one of the terminals. A button has a stop plate extending radially therefrom which is sized to move through the first recess of the flange, and the button is then rotated an angle to shift the stop plate away from the first recess. A resilient member is biased between the stop plate and an inside of the body. By the off alignment of the stop member and the flange, the button is not disengaged from the body.

8 Claims, 10 Drawing Sheets

(ON)

(OFF)

CIRCUIT BREAKER

FIELD OF THE INVENTION

The present invention relates to a circuit breaker that includes a neck integrally connected to the body of the breaker and a stop mechanism for preventing the button from disengaging from the body and the neck.

BACKGROUND OF THE INVENTION

A conventional circuit breaker, shown in FIG. 1 of the attached drawings, includes a body 100 and first and second terminals 200, 300 connected to the body. The terminals 200, 300 extend through two slots defined in an underside of the body 100. A bi-metallic plate 400 is removed in the body 100 and one end of the bi-metallic plate 400 is fixed to the first terminal 200. A first contact point 401 is connected to a second end of the bi-metallic plate 400 so as to be in contact with a second contact point 301 on the second terminal 300 so as to form a circuit. A neck member 101 is fixed to the body 100 and an end of a button 500 extends through the neck member 101 and a spring 501 is biased between an end of the button 500 and an inside of the body 100. The button 500 is movably extended through the neck member 101 and an inside of the button 500 is engaged with an inner periphery of the neck member 101 so that the button 500 is not disengaged from the neck member 101. When current overflow, the bi-metallic plate 400 is deformed so that the first contact point 401 moves away from the second contact point 301 to cut the circuit off.

Nevertheless, the neck member 101 and the first part 102 of the body 100 have to be manufactured individually by two different molds which increase the cost. Besides, it takes a lot of time to assemble the separated parts. Furthermore, when assembling the button 500, the neck member 101 and the spring 501 into the body 100, all the parts are not well settled in position so that the assemblers have to carefully position these parts during assembling. When one of these parts is not positioned at desired position during assembling, the assembling process has to be re-assembled all over again.

Therefore, it is desired to develop a new and simple structure for the circuit breaker that reduces the manufacturing cost and time required to assemble the breaker.

SUMMARY OF THE INVENTION

In accordance with an aspect of the present invention, there is provided a circuit breaker that comprises a body having a neck member integrally connected thereto. A flange extends from an inner periphery of the neck member and a recess is defined in an inner periphery of the flange. A first terminal and a second terminal are connected to the body. A first contact point is fixed to the first terminal. A bi-metallic plate has an end fixed to the second terminal and a second contact point is connected to the bi-metallic plate. A button has a stop plate extending radially therefrom, which is sized to move through the first recess of the flange. The button is rotated an angle to shift the stop plate away from the first recess. A resilient member is biased between the stop plate and an inside of the body. When overloaded, the bi-metallic plate is deformed and the first and second contact points are separated, the button is pushed upward by the resilient member and stopped by the flange.

The main object of the present invention, there is to provide an integral body and neck member so that the structure of the circuit breaker is simplified and the manufacturing cost is reduced.

Another object of the present invention, there is to provide an integral circuit breaker that is compact so that the circuit breaker is suitable for use with compact appliances.

The present invention will become more obvious from the following description when taken in connection with the accompanying drawings, which show, for purposes of illustration only, a preferred embodiment in accordance with the present invention.

DETAILED DESCRIPTION OF THE PREFERRED EMBODIMENT

Figure 1:
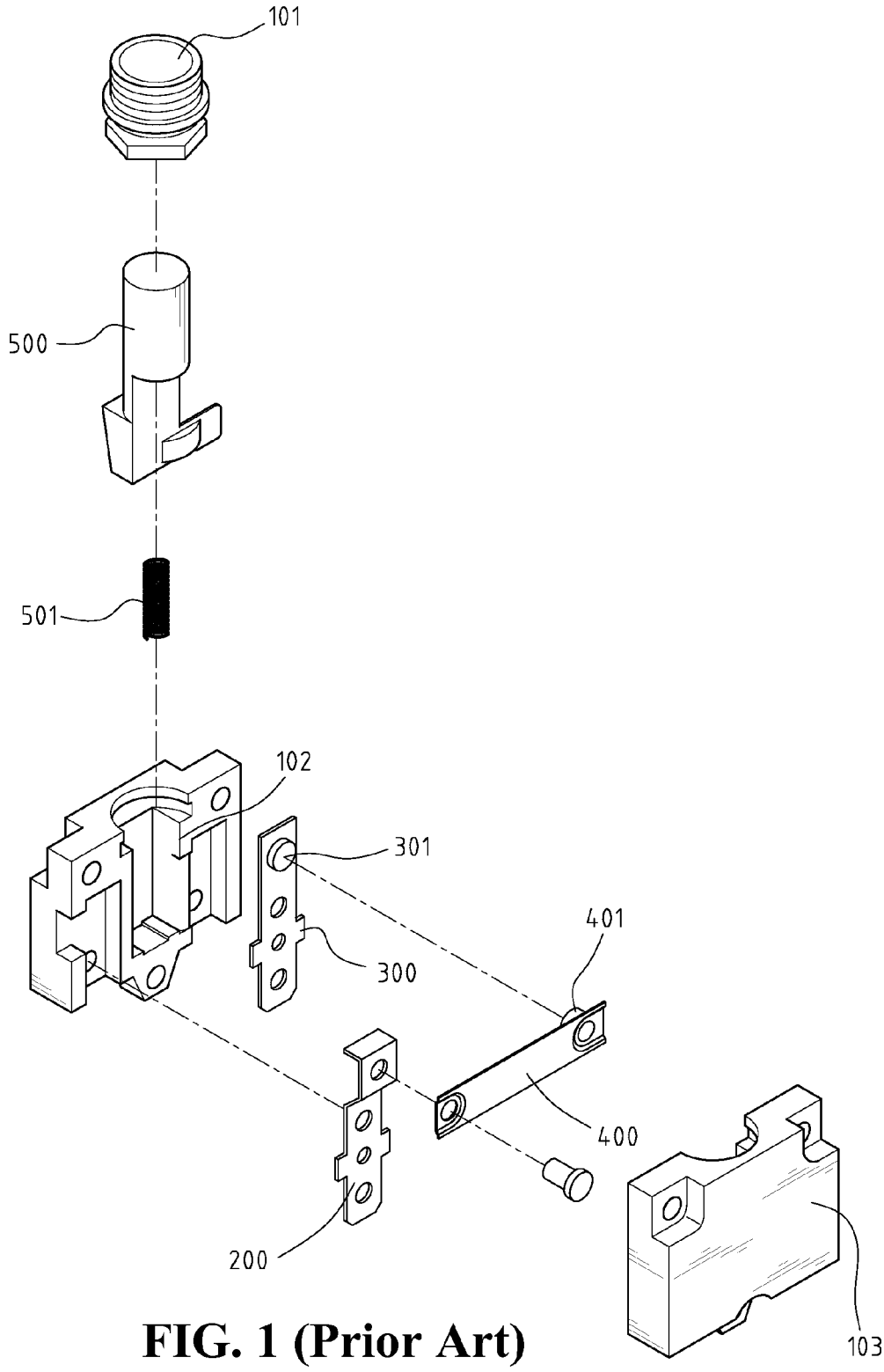
FIG. 1 (Prior Art)
FIG. 1 is an exploded view of a conventional circuit breaker.
Figure 2:
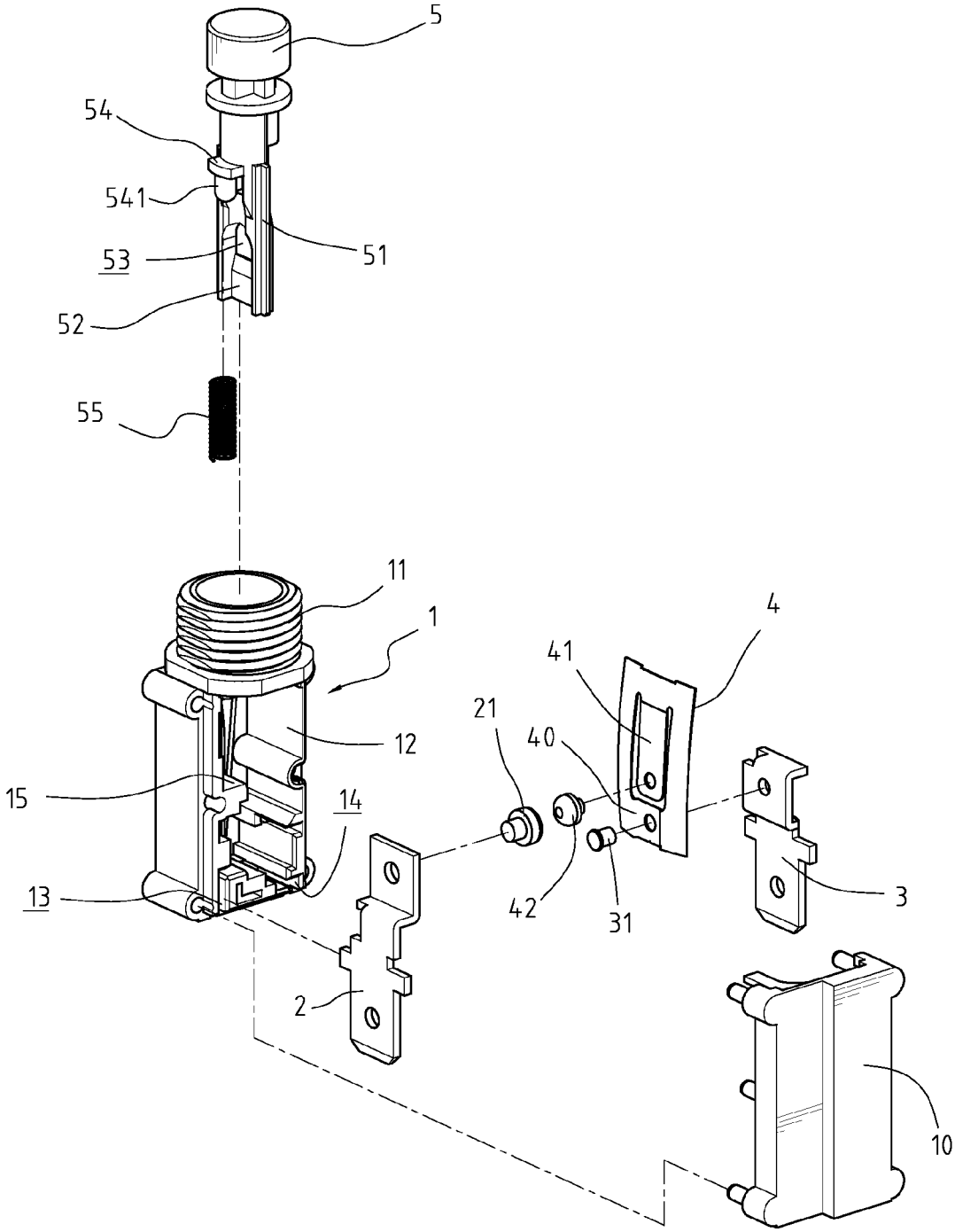
FIG. 2 is an exploded view of a circuit breaker constructed in accordance with the present invention.
Figure 3:
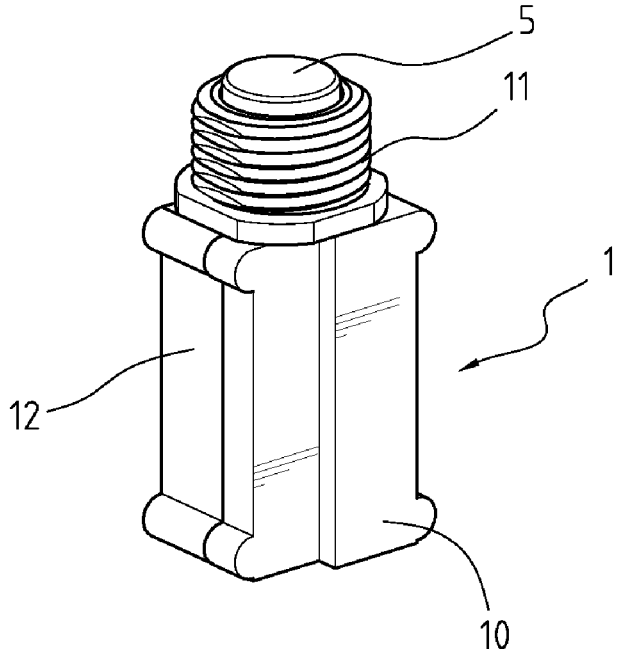
FIG. 3 is a perspective view of the circuit breaker of the present invention.

Referring to the drawings and in particular FIGS. 2-4, 6 and 7, a circuit breaker comprises a body 1 having a neck member 11 which is integrally connected to the body 1. The body 1 is composed of a first part 10 and a second part 12, two slots 13, 14 are defined through an underside thereof so that a first terminal 2 and a second terminal 3 respectively extend through the two slots 13, 14. A first contact point 21 is fixed to the first terminal 2 and a bi-metallic plate 4 has an end fixed to the second terminal 3 by a rivet 31. A second contact point 42 is connected to a free end of a tongue 41 of the bi-metallic plate 4. The bi-metallic plate 4 has a U-shaped slit so as to form the tongue 41 at a center of the bi-metallic plate 4 and one end of the tongue 41 is integrally connected to the bi-metallic plate 4. The tongue 41 has a free end on which a second contact point 42 is connected and the second contact point 42 is located corresponding to the first contact point 21. The bi-metallic plate 4 includes a pressed area 40 and a width of the pressed area 40 gradually reduces to make the bi-metallic plate 4 to be a curved plate. The tongue 41 extends toward an opposite direction of a curvature of the bi-metallic plate 4 so as to be in contact with the first contact point 21. The tongue 41 extends away from the first contact point 21 when the bi-metallic plate 4 is deformed due to current overflow. A flange 16 extends from an inner periphery of the neck member 11 and a first recess 161 and a second recess 162 are defined in an inner periphery of the flange 16.

A button 5 has a cylindrical head and an elongate portion, which includes a recessed separation portion 52, and an aperture 53 is defined through the separation portion 52. The elongate portion is located between the first terminal 2 and the bi-metallic plate 4. A stop plate 54 extends radially therefrom which is sized to move through the first recess 161 of the flange. 16. A stud 541 extends from the stop plate 54 so that a resilient member 55 such as a spring, has one end mounted to the stud 541 and the other end of the resilient member 55 is in contact with an extension 15 extending from an inside of the first part 12 of the body 1.

Figure 4:
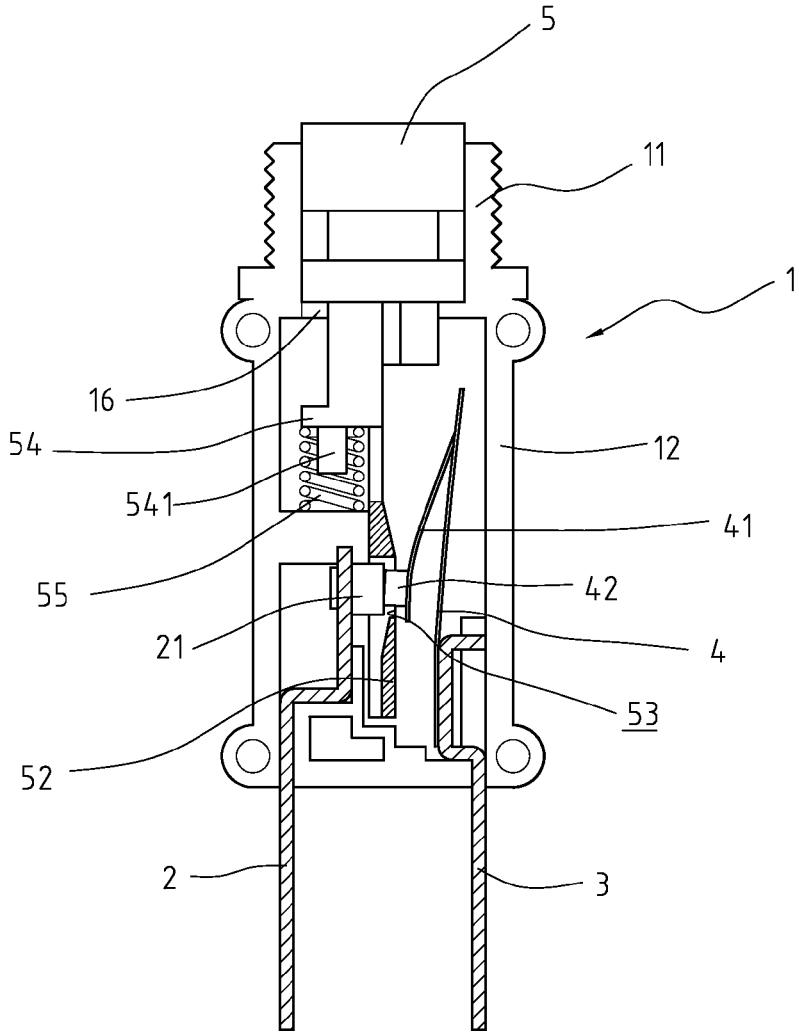
FIG. 4 is a cross-sectional view of the circuit breaker of the present invention when the two contact points are in contact with each other.

Referring to FIGS. 6 to 9, when assembling the button 5 to the body 1, the elongate portion extends through a hole enclosed by the flange 16 and a ridge 51 on a side of the elongate portion extends through the second recess 162. The button 5 is then rotated an angle so that the stop plate 54 will be stopped by the flange 16 when the button 5 is pushed upward by the resilient member 55. This ensures that the button 5 is not disengaged form the neck member 11. The elongate portion of the button 5 is located between the first terminal 2 and the bi-metallic plate 4 so that when the circuit is in "ON" status as shown in FIG. 4, the first and second contact points 21, 42 are in contact with each other via the aperture 53.

Figure 5:
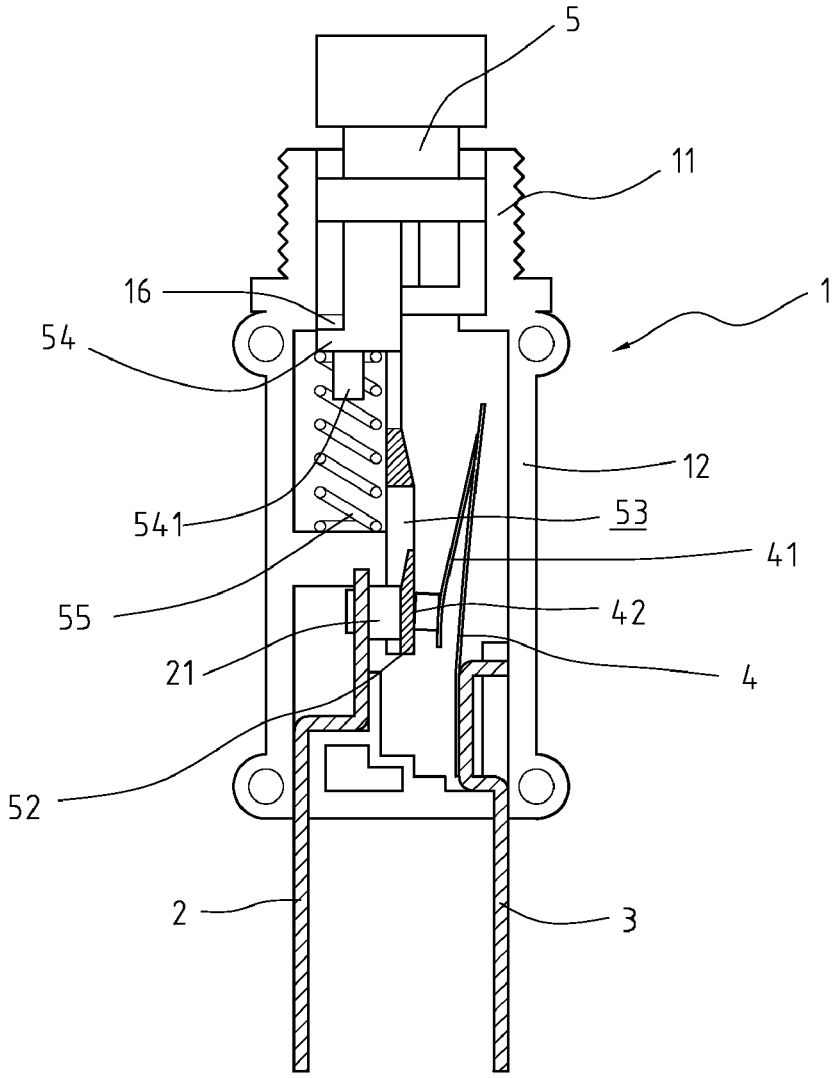
FIG. 5 is a cross-sectional view of the circuit breaker of the present invention wherein the two contact points are separated and the button moves upward.
Figure 6:
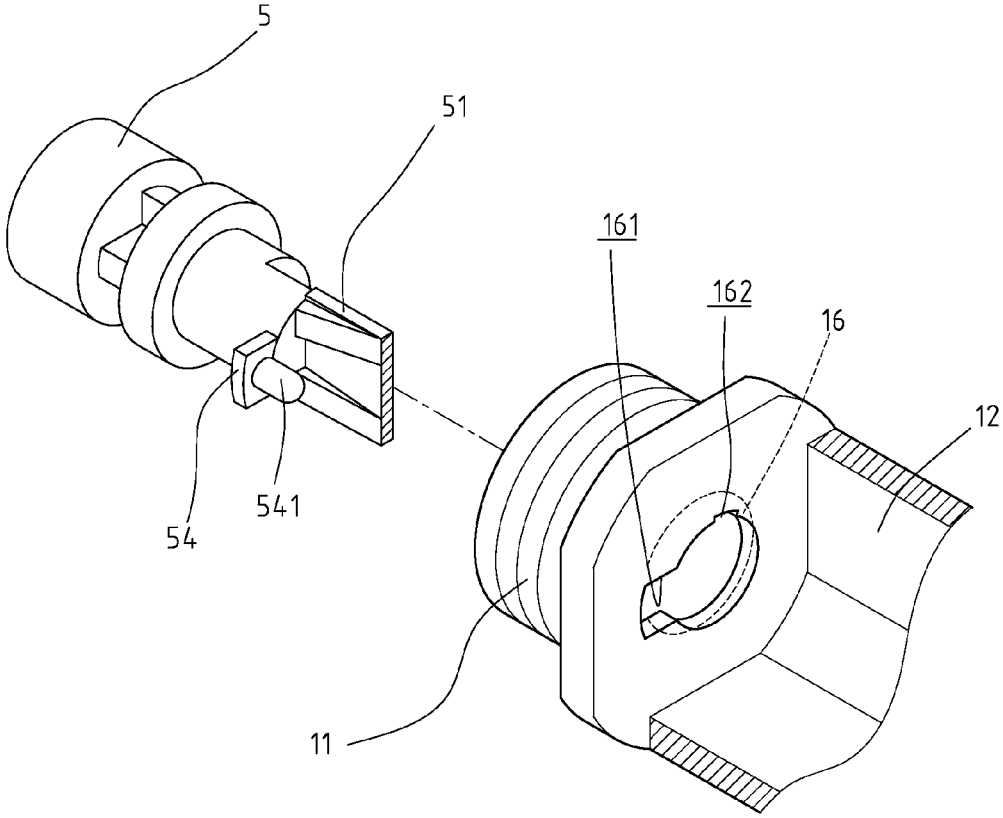
FIG. 6 shows the button and the flange of the neck member having two recesses.
Figure 7:
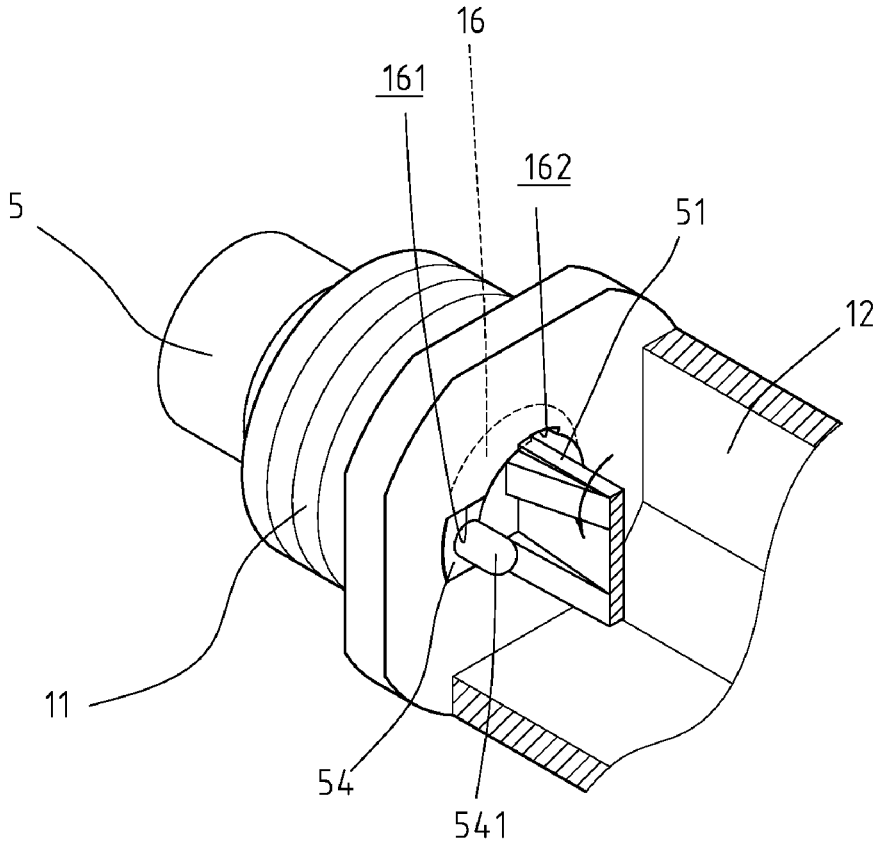
FIG. 7 shows that the elongate portion of the button extends through the hole enclosed by the flange.
Figure 8:
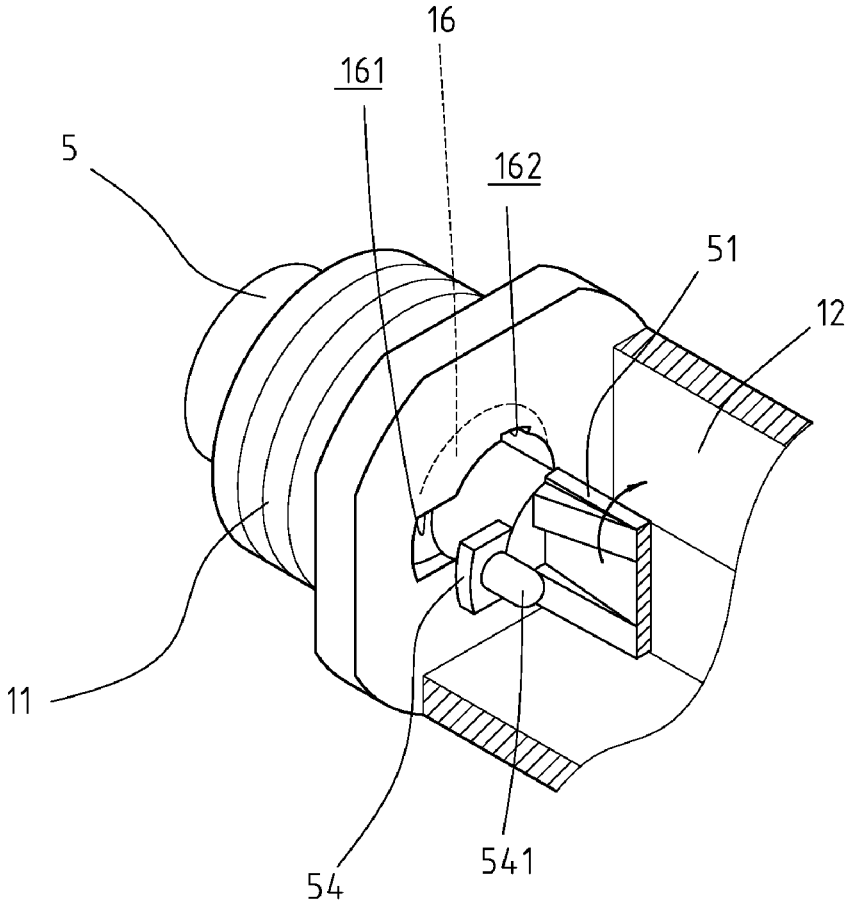
FIG. 8 shows that the elongate portion of the button extends through the hole enclosed by the flange and is to be rotated an angle.
Figure 9:
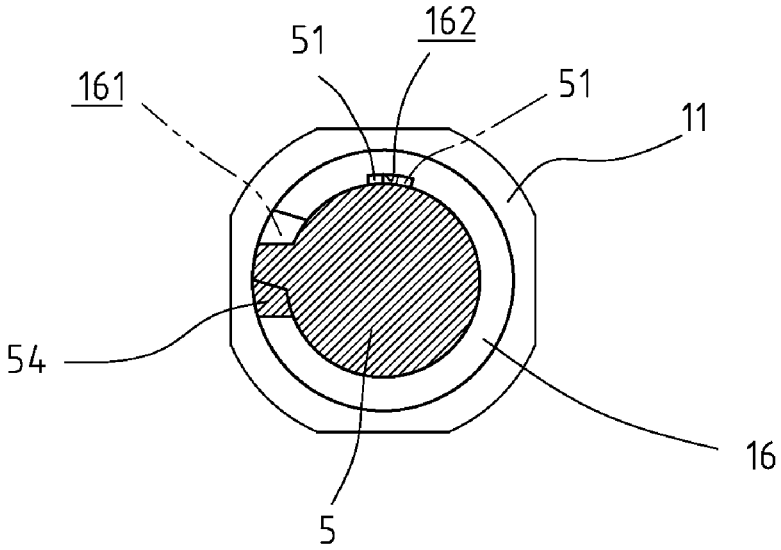
FIG. 9 shows that the stop plate of the button is rotated away from the first recess of the flange of the neck member.

Referring to FIG. 5, when the current overflows, the bi-metallic plate 4 is deformed and the tongue 41 is moved away from the first terminal 2 to separate the first and second contact points 21, 42, so that the circuit is in "OFF" status. The separation portion 52 of the button 5 is then lifted by the resilient member 55 to be located between the first and second contact points 21, 42 to ensure that the first and second contact points 21, 42 cannot be in contact again unless the button 5 is pushed downward again.

Figure 10:
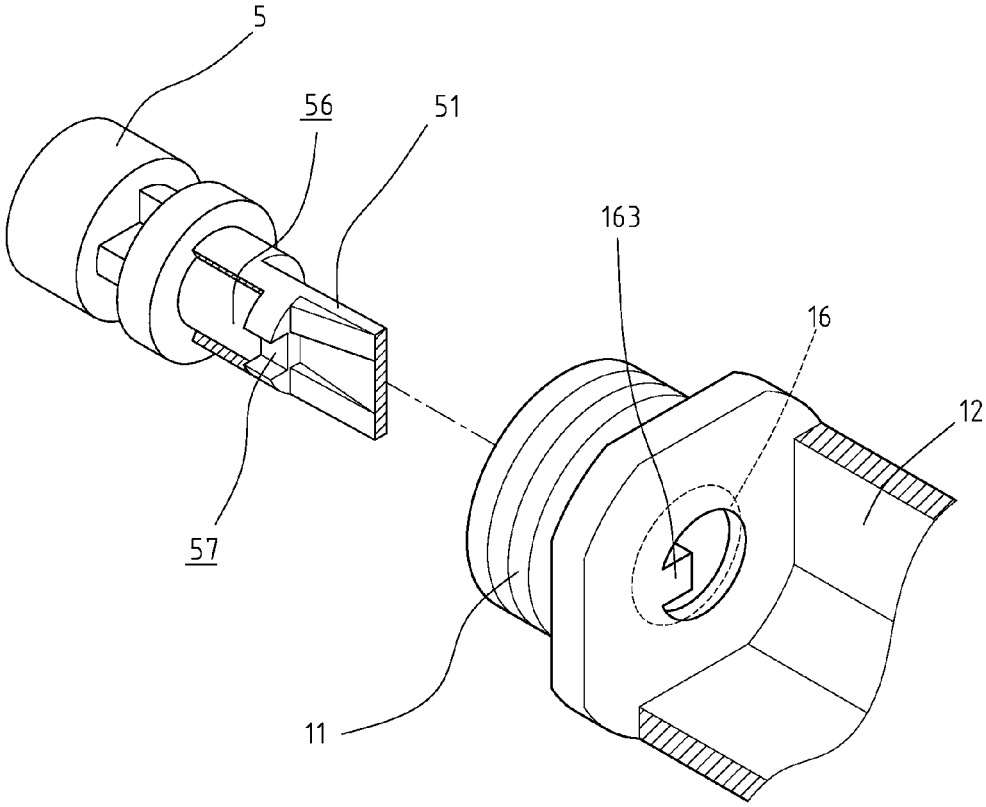
FIG. 10 is an exploded view to show another embodiment of the button and the flange of the neck member.

FIG. 10 shows another embodiment of the present invention wherein the flange 16 extending from an inner periphery of the neck member 11 has a protrusion 163 extending from an inner periphery thereof. The elongate portion of the button 5 has a recess 56 and two jaws extend from two sides of the elongate portion so as to define a notch 57 between the two jaws. The protrusion 163 is sized to move through the notch 57 of the button 5 when assembling the elongate portion of the button 5 with the neck member 11. The button 5 is rotated an angle to shift the jaws away from the protrusion 163 so that the jaws will be stopped by the protrusion 163 when the button 5 is moved upward.

While we have shown and described the embodiment in accordance with the present invention, it should be clear to those skilled in the art that further embodiments may be made without departing from the scope of the present invention.

What is claimed is:

1. A circuit breaker comprising:

a body having a neck member which is integrally connected to the body, a flange extending from an inner periphery of the neck member and a first recess defined in an inner periphery of the flange;

a first terminal and a second terminal connected to the body, a first contact point being fixed to the first terminal, a bi-metallic plate having an end fixed to the second terminal and a second contact point connected to the bi-metallic plate, and a button having a stop plate extending radially therefrom which is sized to move through the first recess of the flange, the button being rotated an angle to shift the stop plate away from the first recess, a resilient member biased between the stop plate and an inside of the body.

2. The circuit breaker as claimed in claim 1, wherein the body includes two slots defined therethrough and the first terminal and the second terminal respectively extend through the two slots, an extension extends from an inside of the body, a stud extends from the stop plate so that the resilient member has one end mounted to the stud and the other end of the resilient member is in contact with the extension.

3. The circuit breaker as claimed in claim 1, wherein the bi-metallic plate includes a tongue which is located at a center of the bi-metallic plate, the tongue has a free end on which the second contact point is connected and the second contact point is located corresponding to the first contact point, the bi-metallic plate is a curved plate so that the tongue extends toward an opposite direction of a curvature of the bi-metallic plate so as to be in contact with the first contact point, the button has an elongate portion which includes a recessed separation portion, an aperture is defined through the separation portion, the elongate portion is located between the first terminal and the bi-metallic plate.

4. The circuit breaker as claimed in claim 1, wherein the resilient member is a spring.

5. The circuit breaker as claimed in claim 3, wherein the bi-metallic plate has a U-shaped slit so as to form the tongue that has one end integrally connected to the bi-metallic plate.

6. The circuit breaker as claimed in claim 3, wherein the bi-metallic plate includes a pressed area and a width of the pressed area gradually reduces to make the bi-metallic plate to be the curved plate.

7. The circuit breaker as claimed in claim 1, wherein the flange has a second recess and the button includes an elongate portion that has a ridge extending through the second recess when the elongate portion extends through a hole enclosed by the flange.

8. A circuit breaker comprising:

a body having a neck member which is integrally connected to the body, a flange extending from an inner periphery of the neck member and a protrusion extending from an inner periphery of the flange;

a first terminal and a second terminal connected to the body, a first contact point being fixed to the first terminal, a bi-metallic plate having an end fixed to the second terminal and a second contact point connected to the bi-metallic plate, and a button having an elongate portion and two jaws extending from two sides of the elongate portion so as to define a notch between the two jaws, the protrusion being sized to move through the notch in the button, a resilient member biased between the jaws and an inside of the body, the button being rotated an angle to shift the jaws away from the protrusion, a resilient member biased between the jaws and an inside of the body.

* * * * *